US005504387A

United States Patent [19]

Hamagishi et al.

[11] Patent Number: 5,504,387

[45] Date of Patent: Apr. 2, 1996

[54] FLAT DISPLAY WHERE A FIRST FILM ELECTRODE, A DIELECTRIC FILM, AND A SECOND FILM ELECTRODE ARE SUCCESSIVELY FORMED ON A BASE PLATE AND ELECTRONS ARE DIRECTLY EMITTED FROM THE FIRST FILM ELECTRODE

[75] Inventors: Goro Hamagishi; Masahiro Sakata; Shunichi Kishimoto, all of Osaka, Japan

[73] Assignee: Sanyo Electric Co., Ltd., Osaka, Japan

[21] Appl. No.: 173,676

[22] Filed: Dec. 23, 1993

[30] Foreign Application Priority Data

Dec. 26, 1992 [JP] Japan ..... 4-358495
Apr. 14, 1993 [JP] Japan ..... 5-112176

[51] Int. Cl.[6] ..... H01J 1/62; H01J 63/04

[52] U.S. Cl. ..... 313/310; 313/495; 313/496

[58] Field of Search ..... 313/309, 336, 313/351, 422, 310, 494, 495, 496

[56] References Cited

U.S. PATENT DOCUMENTS

| | | | |
|---|---|---|---|
| 3,935,500 | 1/1976 | Oess et al. | 313/422 |
| 4,721,885 | 1/1988 | Brodie | 313/351 |
| 4,763,187 | 8/1988 | Biberian | 313/309 |
| 5,015,912 | 5/1991 | Spindt et al. | 313/495 |
| 5,232,549 | 8/1993 | Cathey et al. | 313/309 |
| 5,397,957 | 3/1995 | Zimmerman | 313/308 |
| 5,448,132 | 9/1995 | Komatsu | 313/351 |

FOREIGN PATENT DOCUMENTS

| | | | |
|---|---|---|---|
| 349425 | 1/1990 | European Pat. Off. | 313/496 |
| 5134535 | 8/1984 | Japan | 313/422 |
| 61-230249 | 10/1986 | Japan | 313/422 |

OTHER PUBLICATIONS

V. Galinskiy et al., "Nature of Electroforming of a Thin--Film Cold Cathode", Radiotekhnika i Elektronika, vol. 22, No. 6, 1977, pp. 1302–1304.

R. Meyer, "Recent Development on Microtips Display at Leti" Technical Digest of IVMC 91, Nagahama 1991, pp. 6–9.

P. E. Troyan, R. B. Lubsanov, G. A. Vorobyev, S. A. Ghyngazov, I. V. Lakstroem and S. S. Kramor, "Flat display based on the metal Insulator–metal emitter array" *J. Vac. Sci. Technol. B 11(2), Mar./Apr. 1993,* pp. 514–517.

*Primary Examiner*—Anita Pellman Gross
*Assistant Examiner*—Walter J. Malinowski
*Attorney, Agent, or Firm*—Loeb and Loeb

[57] ABSTRACT

A flat display includes a closed vessel having a front panel (optically transparent) and a back panel, apparatus for emitting electrons by field emission positioned on the back panel, an anode having an anode electrode and at least a phosphor layer positioned on the front panel, and a spacer for defining a distance between the front panel and the back panel. The spacer has an upper cross-section adjacent to the front panel and a lower cross-section adjacent to the back panel. The lower cross-section is larger than the upper cross-section.

4 Claims, 12 Drawing Sheets

FLAT DISPLAY WHERE A FIRST FILM ELECTRODE, A DIELECTRIC FILM, AND A SECOND FILM ELECTRODE ARE SUCCESSIVELY FORMED ON A BASE PLATE AND ELECTRONS ARE DIRECTLY EMITTED FROM THE FIRST FILM ELECTRODE

FIELD OF THE INVENTION

The present invention relates to a flat display. More specifically, the present invention relates to a flat display having a device for emitting electrons by field effect, in which high brightness of a screen of the flat display, long life of the flat display, and the ability to make a large display on the screen, are achieved.

BACKGROUND OF THE INVENTION

Generally, display devices are classified into two types; passive type displays and active type displays. The passive type display generally comprises a light source and a display panel. Light from the light source passes through the display panel and is modulated in transparency to form images or characters. As a result, images or characters are displayed on the display panel. In the passive type display, there is a liquid crystal display, an electrochemical display and an electrophoretic display. A liquid crystal display is typically used for a flat display.

The active type display has a vacuum-tube or a tube in which inert gas is sealingly contained. The vacuum-tube or other sealed tube has a light emitting device of its own. Such tube also has a display screen. The light emitting device emits light, for example, by electric discharge or phosphor excitation by electrons. Images and characters are displayed on the display screen by controlling the light emission of the light emitting device. In the active type display, there is a cathode ray tube (CRT), a gas-electric discharge device, and a display panel comprising light emitting diodes arranged in a matrix form. For a flat display, a plasma display panel (PDP), which is a gas electric discharge device, is typically used.

In the PDP, under relatively high gas pressure, cold cathode emission is achieved between two electrodes having a narrow gap therebetween and, as a result, glow discharge light emission is achieved. In the glow discharge light emission, negative glow is enhanced. Therefore, the light from the negative glow is used to display images or characters.

It should be noted that it is difficult to make a large liquid crystal display panel because of high rejection rate in the manufacturing process.

Further, in order to achieve a bright screen and high contrasted displayed images, it is necessary to use a backlight device.

A PDP uses a glow discharge device as its light source. Since the service life of a glow discharge device is short, the service life of a PDP is short. Further, the display screen of a PDP is dark because light from a negative glow is dark, in comparison with a CRT display.

SUMMARY OF THE INVENTION

An object of the present invention is to provide a flat display which has a bright screen.

Another object of the present invention is to provide a flat display which has a structure capable of providing for making a large size flat display.

Another object of the present invention is to provide a flat display which has long service life.

In accordance with these and other objects, the present invention comprises a closed vessel having a front panel (optically transparent) and a back panel, an electron emitting device for emitting electrons by field emission, disposed on the back panel, an anode device having an anode electrode and at least a phosphor layer for emitting light upon excitation by electrons and disposed adjacent to the front panel, and spacer means for defining a distance between the front panel and the back panel. In one aspect of a preferred embodiment of the present invention, the spacer has an upper cross-section adjacent to the back panel and a lower cross-section adjacent to the back panel. The lower cross-section is larger than the upper cross-section.

In the present invention, electrons emitted from electron emitting device are accelerated by high voltage between the anode and the electron emitting device. Phosphors are excited by accelerated electrons, and emit light. This is the same situation as in a CRT display, and as a result, the display screen achieves high brightness. Further, in comparison with glow discharge, the flat display achieves a long service life, as in the case of a CRT display.

Spacers are located between the front panel and the back panel to define a distance between the front panel and the back panel. According to further embodiments of the present invention, the display apparatus has a spacer having a novel structure for providing spacing of predetermined distance between a front display panel and a back panel. An anode and an electron emitting device are provided adjacent to the front display panel and the back panel, respectively. As a result of the novel structure of the spacer, electrons emitted from the electron emitting device reach the front display panel without any obstructions to the moving electrons. Furthermore, the spacer has a substantially improved structural strength due to the novel structure. As a result, the predetermined distance may be constantly maintained between the front display panel and the back panel over a substantially wide area. Accordingly, a large size display screen is achieved without the fear of short circuit. Due to the constant separation between the front display panel and the back panel, such a large size display facilitates the application of a relatively high voltage between the anode and the electron emitting device, which generate electrons having high energy. As a result, the brightness of such a large display is substantially increased.

DETAILED DESCRIPTION OF THE PREFERRED EMBODIMENTS

Figure 1:
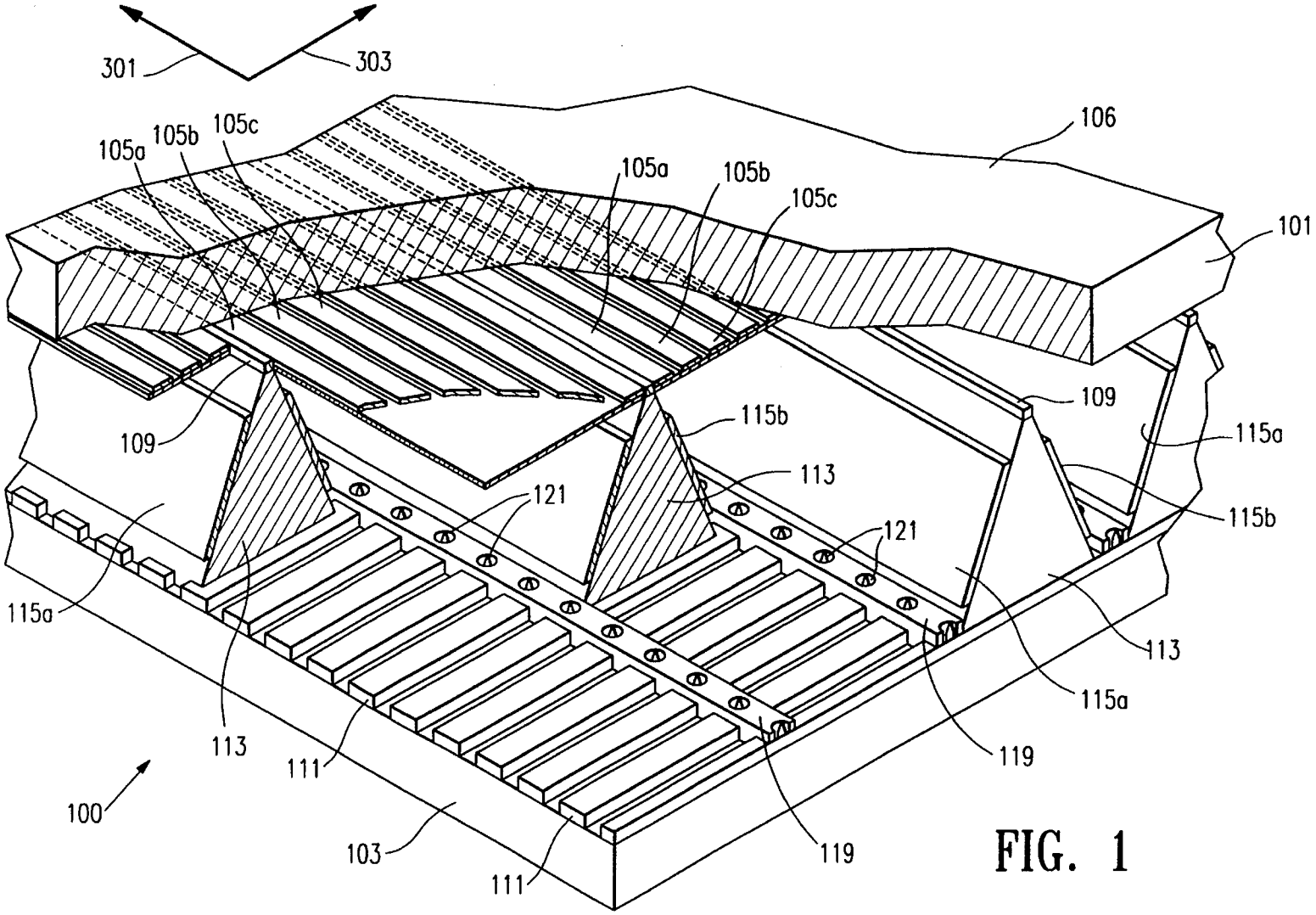
FIG. 1 is a perspective view, partly broken away, of a first embodiment of a flat display in accordance with the present invention.

Flat displays in accordance with several embodiments of the present invention are described below in detail with reference to the drawings.

In a first embodiment of the present invention, shown in FIGS. 1–4, a flat display 100 basically comprises a closed vessel having a front panel 101 and a back panel 103. The front panel 101 is made from an optically transparent material such as, for example, a glass plate. The space between the front panel 101 and the back panel 103 of the closed vessel, may be evacuated or charged with inert gas such as, for example, Ar, Ne or He.

In this embodiment, an anode device has an optically transparent electrode (not shown in FIG. 1), phosphors and a thin metal film. The optically transparent electrode and the metal thin film are electrically connected to each other and used as an anode electrode.

The optically transparent electrode, formed from an optically transparent material, such as Indium Tin Oxide (ITO), may be disposed behind the front panel 101. Three kinds of strips of phosphor 105*a*, 105*b*, and 105*c* are periodically coated behind the transparent electrode along a column extending in the same direction as a vertical scanning direction 301 of a display screen 106. The strips of phosphor 105*a*, 105*b*, and 105*c* respectively represent three components of light; R (red), G (green) and B (blue). Therefore, they respectively emit red light, green light, blue light upon excitation by electrons. A thin metal film 107 is formed for covering the strips of phosphor 105*a*, 105*b* and 105*c*. In the present embodiment, the metal thin film 107 is formed from an aluminum thin film.

The aluminum thin film 107 protects the strips of phosphor 105*a*, 105*b*, 105*c* from degradation which may be caused by collision of ionized impurities (for example oxygen) under application of high voltages to the anode electrode.

There is a danger that the aluminum thin film will be partly torn during the manufacturing process. A partly torn aluminum thin film may cause nonuniformity in the electrical potential thereof. The nonuniformity in electrical potential results in nonuniformity of the energy of electrons which excite the phosphors. As a result, there may be nonuniform distribution of brightness across the display screen. In this embodiment, the transparent electrode and the aluminum thin film 107 are electrically connected to each other. Therefore, as the anode electrode, the nonuniformity of electrical potential of the anode electrode is minimized.

It is possible to use only an optically transparent electrode or an aluminum thin film as the anode electrode.

For the phosphor strips 105*a*, 105*b* and 105*c*, it is preferable to use yttrium sulfide oxide ($Y_2O_2S$) and europium (Eu) ($Y_2O_2S$:Eu) for red light, zinc sulfide (ZnS), copper (Cu) and aluminum (Al) and zinc sulfide, gold (Au) and aluminum (ZnS:Cu, Al+ZnS:Au, Al) for green light, zinc sulfide (ZnS) and silver (Ag) (ZnS:Ag) for blue light. In a monochrome flat display, it is preferable to use zinc sulfide (ZnS), silver (Ag) and zinc sulfide, cadmium sulfide (CdS) and silver (ZnS:Ag+(Zn, Cd)S:Ag) for white light.

First spacers 109 are formed behind the anode electrode 107 in the column direction 301 of the display screen 106. The first spacers 109 are formed by a thick film printing method using an insulator paste. In this embodiment, between adjacent pairs of the first spacers 109, there are six strips of phosphor 105*a*, 105*b*, 105*c*, 105*a*, 105*b*, 105*c*, which respectively represent R, G, B, R, G and B light.

Plural cathode electrodes 111 are formed on the back panel 103 in a row direction (the row direction is the same direction as a horizontal scanning direction 303 of the display screen 106), which direction is perpendicular to the column direction 301 of the display screen 106. Also the cathode electrodes 111 are formed in parallel with each other.

Second spacers 113 are formed on the cathode electrodes 111 in the column direction 301 of the display screen 106. The second spacers 113 are positioned between the first spacers 109 and the cathode electrodes 111. The second spacers 113 are formed from an insulation material and generally define the distance between the front panel 101 and the back panel 103. The second spacers 113 are preferably formed from ceramics.

Preferably, the cross-sectional shape of the second spacers 113 is generally triangular as shown in FIG. 1. A vertex of each second spacer 113 contacts a first spacer 109. The base of the second spacer 113 is disposed on the cathode electrodes 111. Because of the triangular cross-sectional shape of the second spacers 113, which maintain substantial structural strength, ample spaces are provided for the strips of phosphor 105*a*, 105*b*, 105*c*. Deflection electrodes 115*a* and 115*b* are formed on both side surfaces of each of the second spacers 113.

Figure 2:
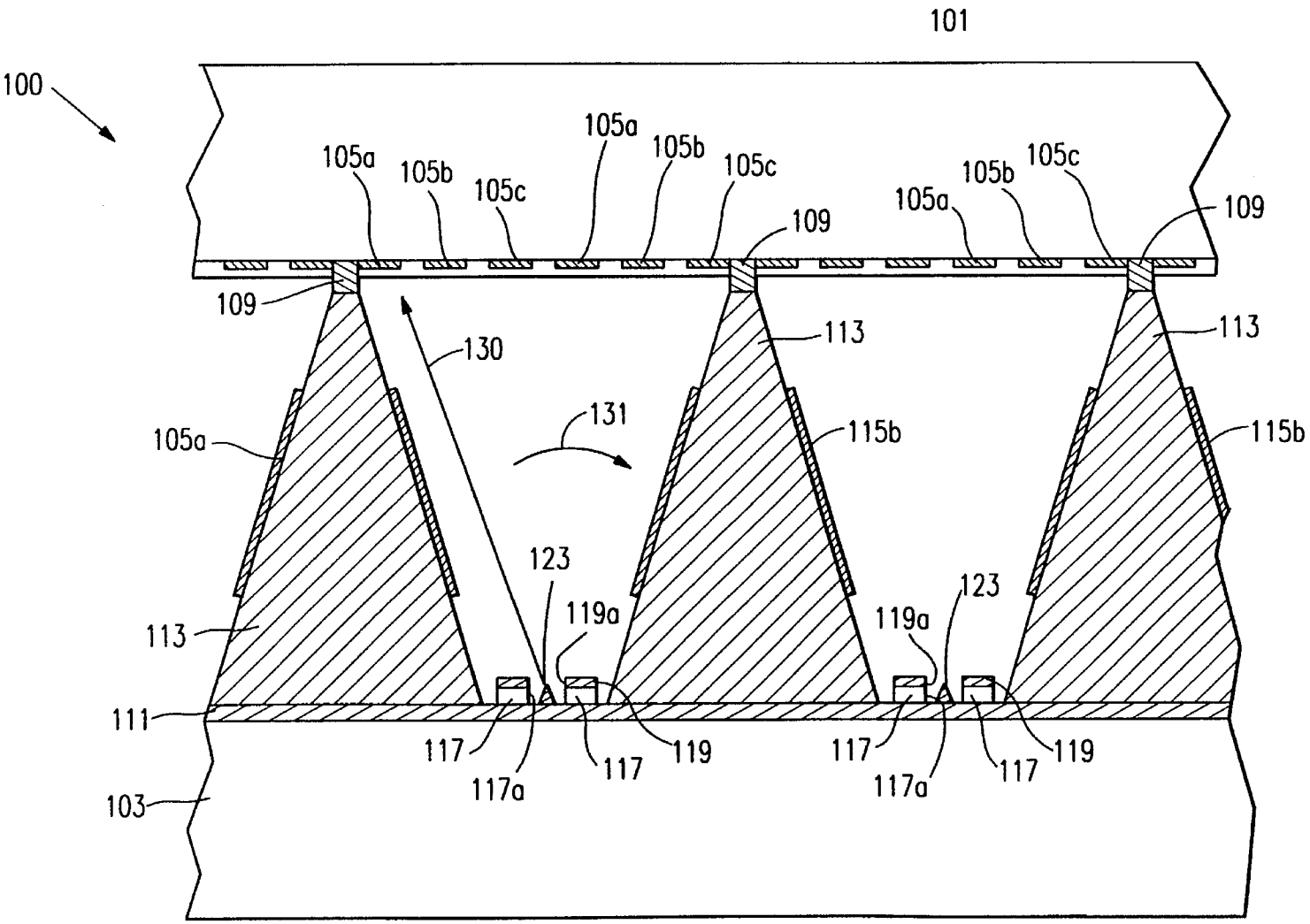
FIG. 2 is a sectional view of the flat display of FIG. 1.

Further, as shown in FIG. 2, insulators 117 are formed on the cathode electrodes 111 in the column direction 301 of the screen display 106. The insulators 117 are located between adjacent pairs of the second spacers 113 and 113. Gate electrodes 119 are formed on the insulators 117. At a cross area of each cathode electrode 111 and each gate electrode 119, an electron emitting device 121 is formed. In each electron emitting device 121, there are holes 117*a*, 119*a*, formed respectively in the insulators 117 and gate electrodes 119, and Spindt type emitters 123 are formed in these holes 117*a* and 119*a*. The emitter 123 is preferably in the shape of cone.

In FIG. 1 and in FIG. 2, to simplify the drawing, only one emitter 123 is shown in one electron emitting device 121. In actuality, however, numerous sets of holes and emitters are provided in a predetermined area adjacent to the intersection between each cathode electrode 111 and each gate electrode 119. In a preferred embodiment, about 10,000 emitters are arranged at a pitch of several micron millimeters in one electron emitting device 121. These emitters 123 in each one of the electron emitting devices 121 are controlled as a unit, as described below.

As will be apparent from FIG. 1 and FIG. 2, a space (hereinafter "defined space") is defined by an adjacent pair of the second spacers 113. In the defined space, there are a plurality of electron emitting devices 121 arranged in the column direction 301, a pair of the deflection electrodes 115*a* and 115*b* and six strips of phosphor 105*a*, 105*b*, 105*c*, 105*a*, 105*b*, and 105*c* (two pair of R, G and B phosphors). In this embodiment, the defined space comprises two lines of display elements in the vertical scanning direction on a displayed image. Each display element has R, G and B phosphor.

Figure 3:
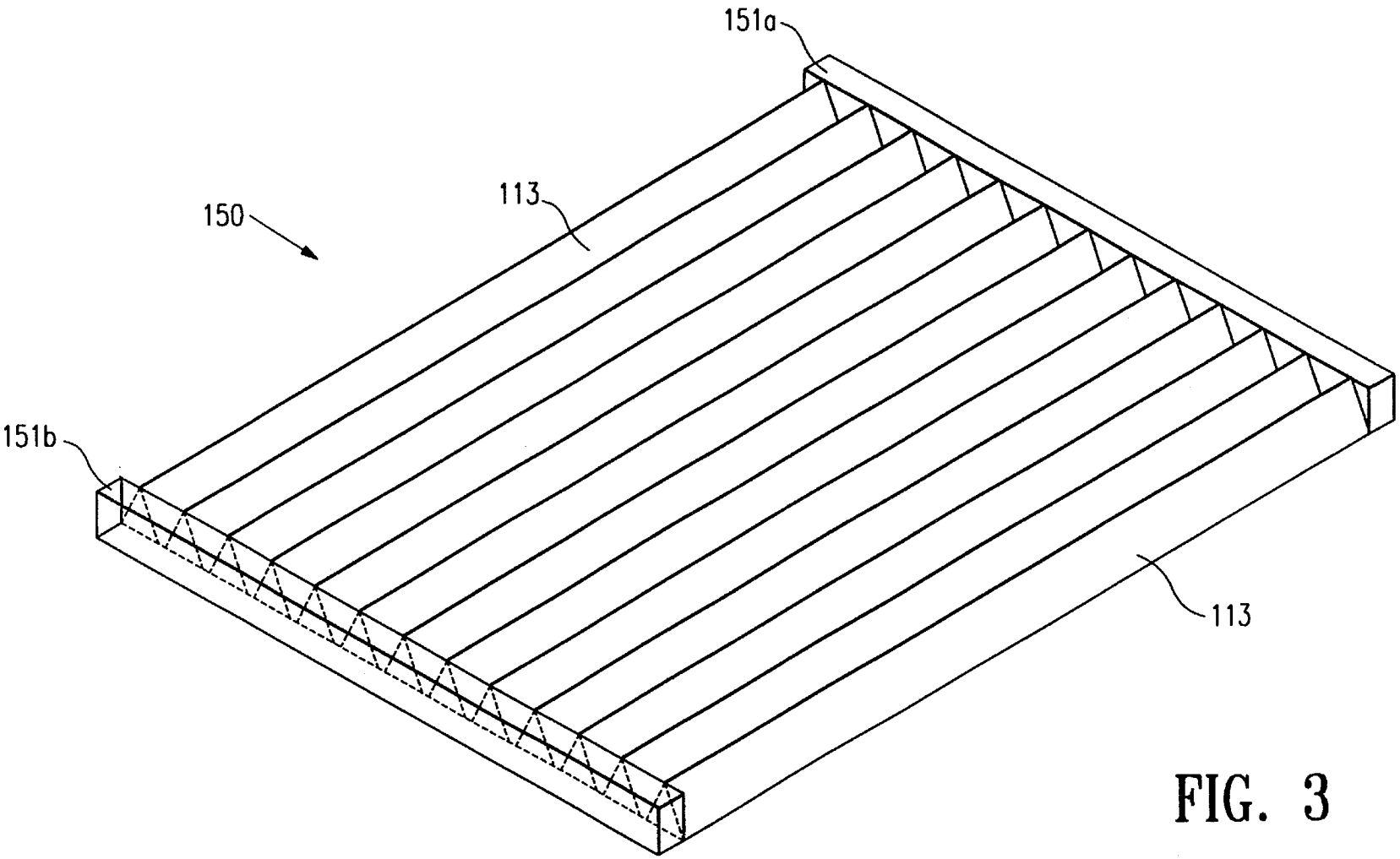
FIG. 3 is a perspective view of a spacer forming a part of the flat display of FIG. 1.
Figure 4:
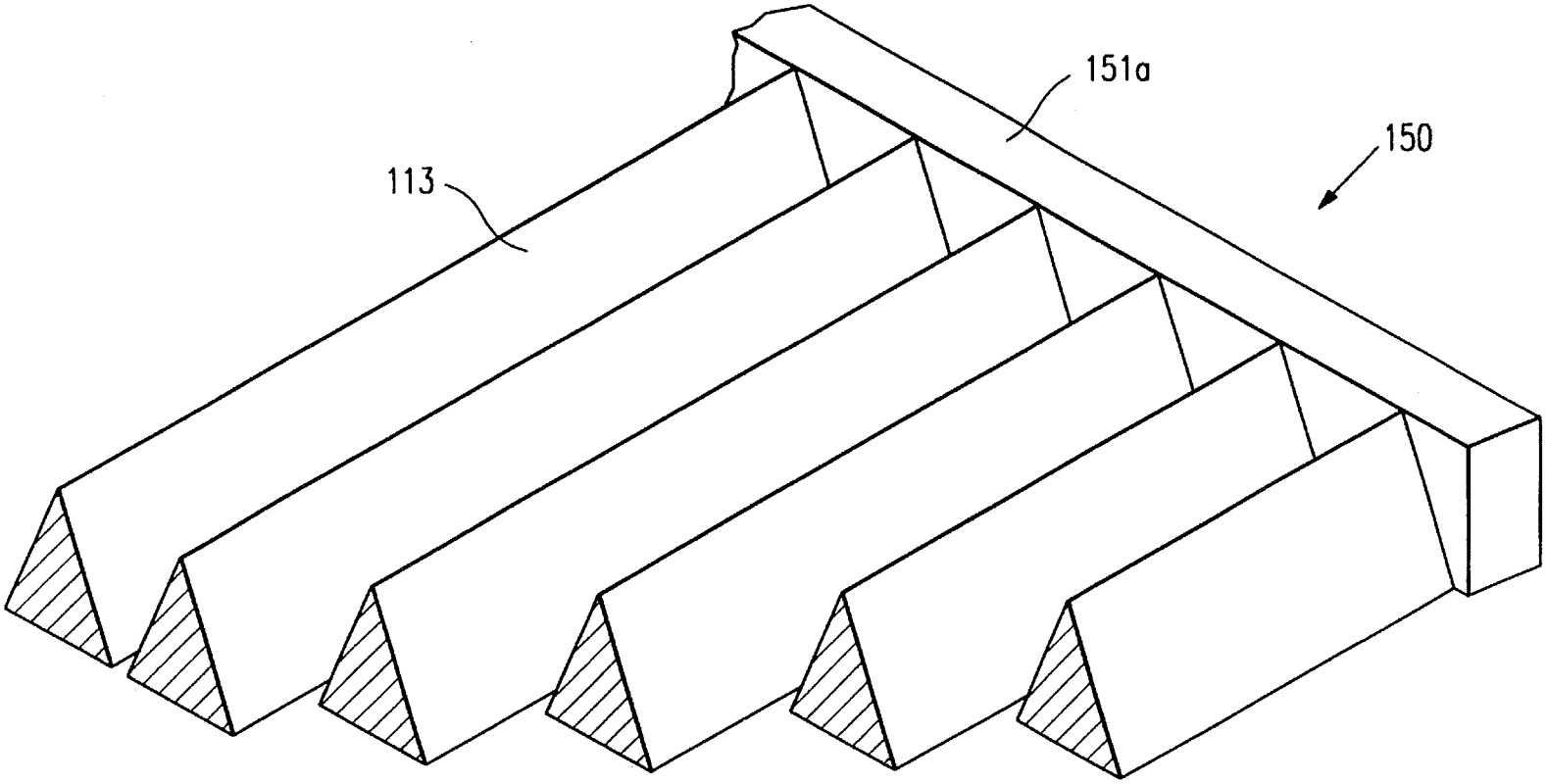
FIG. 4 is a close-up perspective view of a portion of the spacer of FIG. 3.

According to the present invention, as shown in FIG. 3 and FIG. 4, the second spacers 113 may be positioned at a predetermined pitch and held together by holders 151*a* and 151*b* at both sides of the second spacers 113. The spacers 113 are preferably made from ceramics. By using this structure 150, the manufacturing process of a flat display is simplified. After forming the electron emitting device 121 on the back panel 103, the second spacers 113 are disposed on the back panel. Further, it is preferable to form the deflection electrodes 115*a* and 115*b* on the side faces of the second spacer 113 before positioning the second spacer 113 on the back panel 103. As a result, the manufacturing process is further simplified.

Electron emission by field effect is achieved by applying a voltage of several hundreds volts between a gate electrode 119 (positive) and a cathode electrode 111 (negative). One of the cathode electrodes 111 corresponding to a selected horizontal line of an image to be displayed on the screen is selected by applying predetermined negative voltages. A predetermined positive voltage and a voltage signal corresponding to an image to be displayed on the screen are applied to the gate electrode 119. As a result, electrons are emitted from the selected electron emitting device and the quantity of electrons by field emission is changed by the voltage signal corresponding to the image to be displayed on the screen.

In each defined space, a deflection control voltage is applied to the deflection electrodes 115*a* and 115*b*. The deflection control voltage deflects a path 130 (shown in FIG. 2) of electrons emitted from electron emitter 121 in an electron scanning direction 131 in a predetermined period. The electron scanning direction 131 is in the same direction as the horizontal scanning direction 301 of the display screen 106.

According to this embodiment, while the electron path 130 is deflected in the electron scanning direction 131, the quantity of electrons from the electron emitting device 121 are changed by the voltage signal corresponding to the image to be displayed on the screen, and the electrons are accelerated by an anode voltage applied between the anode electrode 107 and cathode electrode 111. The three phosphors 105*a*, 105*b*, and 105*c* (which respectively correspond to red light, green light and blue light) are excited in turn by electrons to thereby emit light of corresponding color. As a result, color images are displayed on the screen.

In this embodiment, the height of the second spacer is approximately 2 mm (millimeter), for example. A voltage of more than 10,000 volts may be applied between the anode electrode 107 and the cathode electrode 111. As a result, the electrons which have a high energy excite the phosphors, and therefore light emitted from the phosphors becomes as in the case of bright as a CRT.

The space between the panel 101 and the back panel 103 may be evacuated or charged with inert gas. As a result, degradation of cathode electrodes which may otherwise be caused by spattering of positive ions does not occur. It is appreciated that the spattering of positive ions to cathode electrodes occurs in the PDP system. Therefore, a service time of display in accordance with the present invention is longer than in the PDP system.

Further, although the second spacers are closely located to each other, paths of electrons emitted from the electron emitting devices are not obstructed. As a result, even in the case of a large display screen, the distance between the front panel 101 and the back panel 103 is uniformly maintained across a substantially large area.

Figure 5:
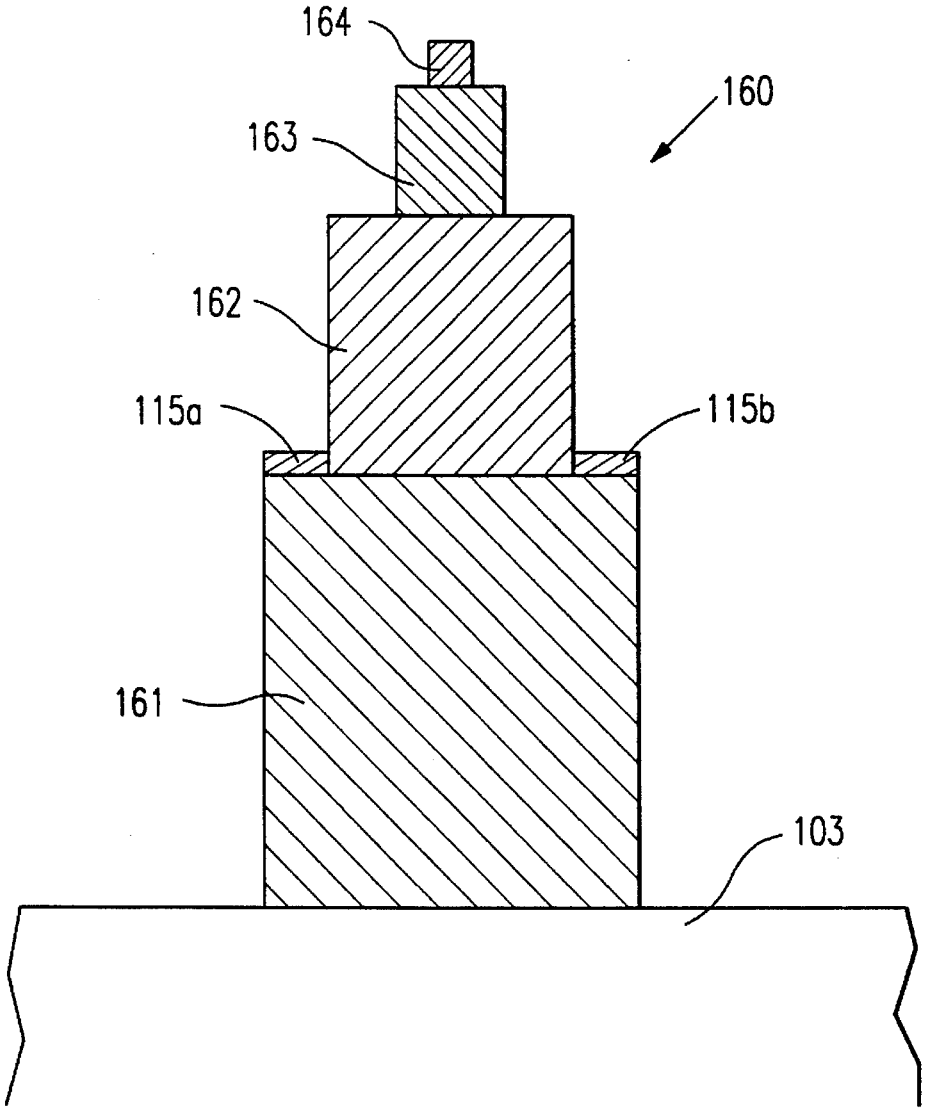
FIG. 5 is a sectional view of a spacer used in a second embodiment of a flat display according to the present invention.

FIG. 5 shows another embodiment. A second spacer 160 is formed by a thick film printing method using an insulator paste. In this embodiment, four layers 161, 162, 163 and 164 of insulator paste are formed on the back panel 103. As shown in FIG. 5, the layer nearer to the back panel 103 is larger than the layer nearer to the front panel 101. As a result, the strength of the second spacer is maintained. The deflection electrodes 115*a* and 115*b* are formed on the layer 161 by a thin film printing method.

Figure 6:
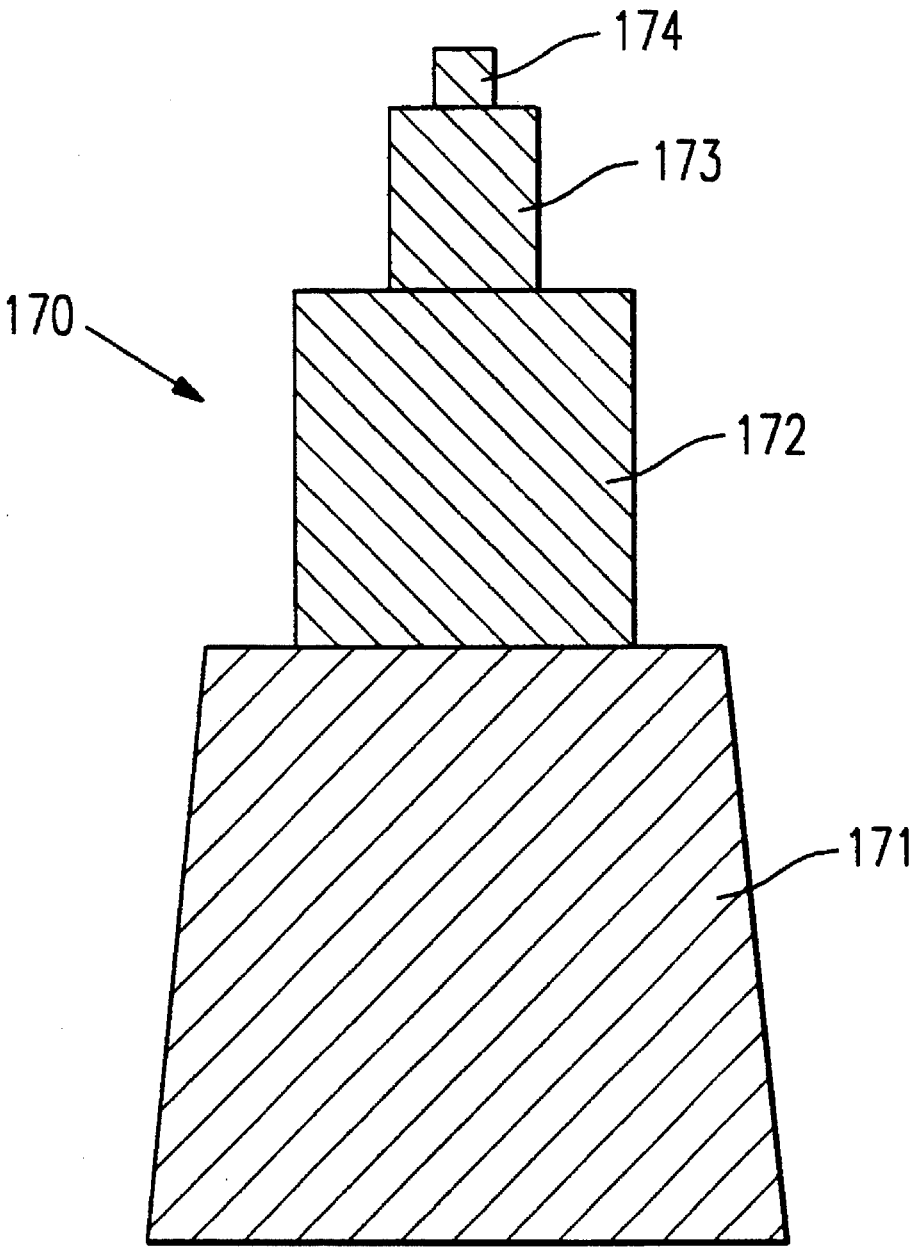
FIG. 6 is a sectional view of a spacer used in a third embodiment of a flat display according to the present invention.

In FIG. 6, still another form of a second spacer is shown. In this embodiment, a second spacer 170 comprises a trapezoidal body of ceramics 171 and three layers 172, 173 and 174 of insulator paste. The three layers 172, 173 and 174 are formed on the trapezoid body 171 by a thick film printing method. In this embodiment, one printing process can be omitted from the process used in the embodiment of FIG. 5. Further, alignment accuracy between the first spacer 109 and the second spacer 113 is very much improved, because the first and second spacers are formed by the same method.

In the above embodiments, the first spacer 109 is formed to prevent damage to the anode electrode and the phosphors by the tip of the second spacer, when the front panel 101 with the first spacer and the back panel 103 with the second spacer are combined.

Use of the second spacers 113 made from ceramics prevents degradation of the electron emitting device 121 by oxidation occurring during the thick film printing and baking process which is for the second spacer 160 and 170 in FIGS. 5 and 6.

In the above embodiments, each electron emitting device corresponding to each defined space comprises one gate electrode and a plurality of cathode electrodes. On the other hand, each electron emitting device corresponding to each defined space may comprise one cathode electrode and a plurality of gate electrodes.

As to the phosphors, in the embodiment shown in FIG. 1 to FIG. 5, strips of phosphors 105*a* 105*b* 105*c* are located in the column direction of the display screen. It is possible to arrange strips of phosphors only in the row direction of the display screen, or to arrange the strips of phosphors in a matrix form.

Figure 7:
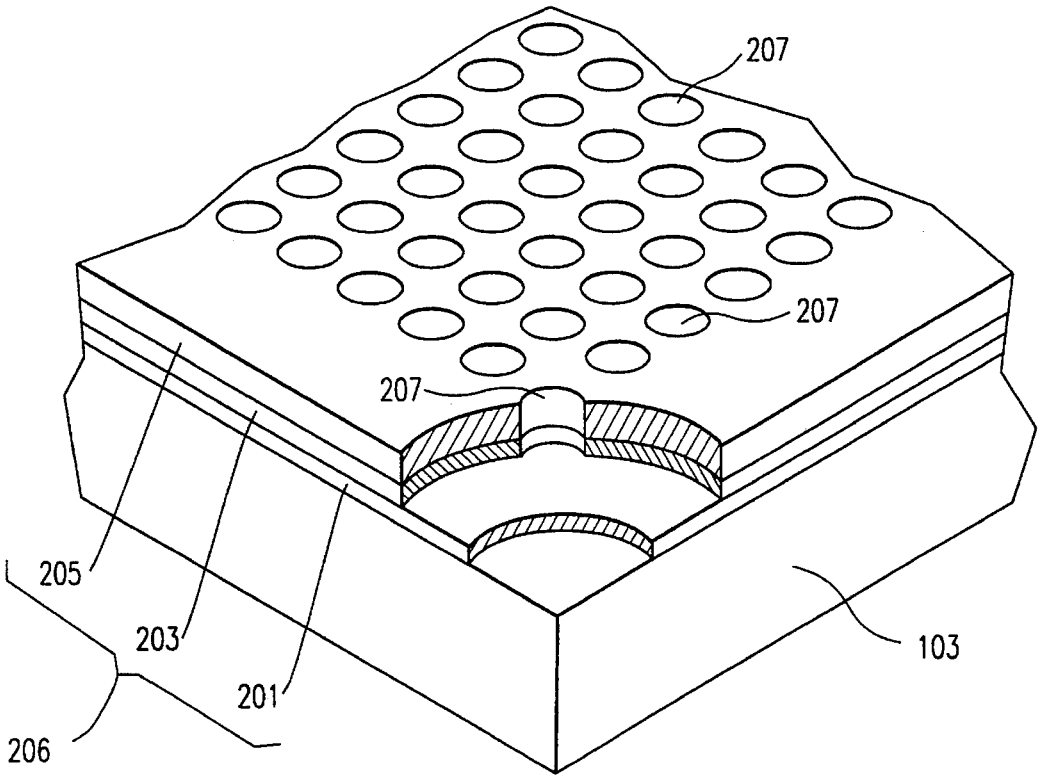
FIG. 7 is a perspective view of an embodiment of an electron emitting device.

FIG. 7 shows still another embodiment of the electron emitting device. A first film electrode 201 is formed on the back panel 103 by a thin film technique such as, for example, a vacuum evaporation method. A dielectric film 203 is formed on the first film electrode 201 by thin film technique. A second film electrode 205 is formed on the dielectric film 203. Further, numerous minute pinholes 207 are formed at the same pitch. The pinholes are formed through the second film electrode 205 and the dielectric film 203. An electron emitting device 206 comprises a first film electrode 201, a dielectric film 203 and a second film electrode 205.

Figure 8:
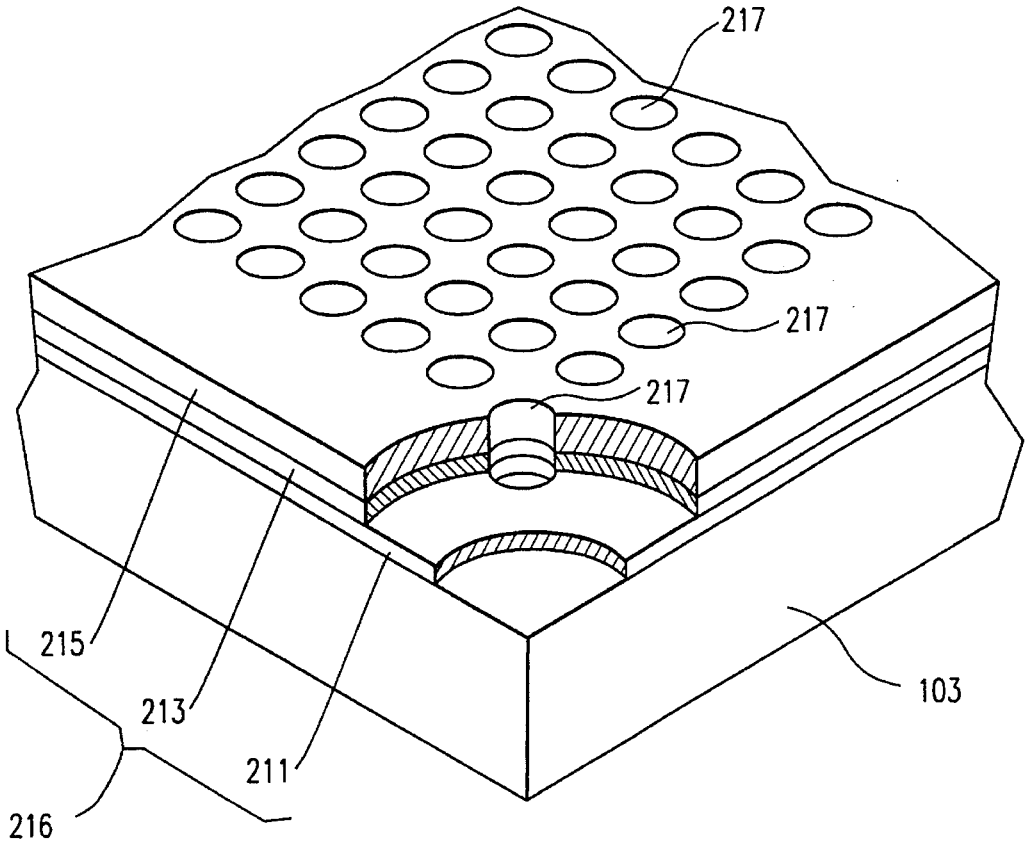
FIG. 8 is a perspective view of another embodiment of an electron emitting device.

In FIG. 8, a first film electrode 211, a dielectric film 213 and a second film electrode 215 are formed, in this order, on the back panel 103 by thin film technique. Further, numerous pinholes 217 are formed at the same pitch. The pinholes 217 are formed through the first film electrode 211, the dielectric film 213 and the second film electrode 215. An electron emitting device 216 comprises the first film electrode 211, the dielectric film 213 and the second film electrode 215.

In the case of the structure shown in FIG. 7 and FIG. 8, it is not necessary to form each of the emitters in the shape of a cone, as shown in FIG. 2. Therefore, the manufacturing process is simpler than that used to form the structure shown in FIG. 2.

Figure 9:
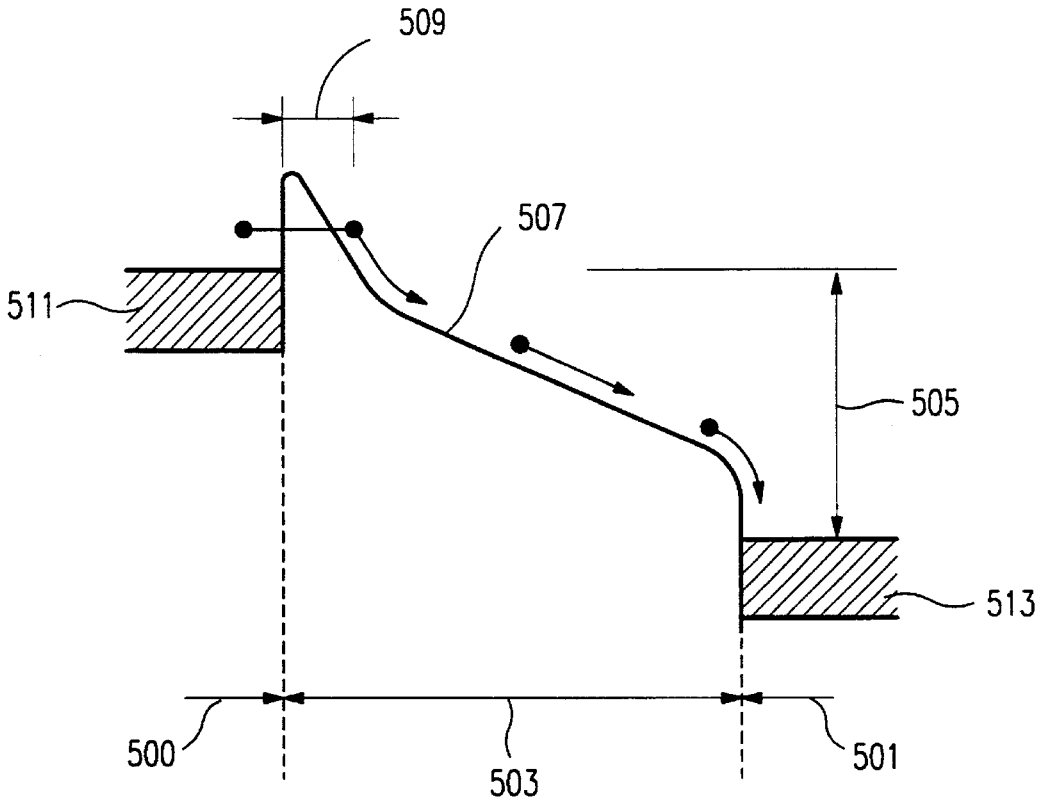
FIG. 9 is an illustration useful in explaining the operation of the electron emitting device shown in FIG. 8 and FIG. 7.

In the case of the structure shown in both FIG. 7 and FIG. 8, a relatively high voltages is applied between the first electrode 201 and second electrode 203 to causes electron emission by field emission. FIG. 9 shows a mechanism for the field emission. In FIG. 9, a first electrode region 500, a second electrode region 501, a vacuum region 503, an energy level difference 505 between an energy band 511 of the first electrode and an energy band 513 of the second electrode, a potential barrier 507 and a strong electric field region 509 are shown.

If an electric field strength on the surface of the first film electrode 201 is almost $10^9$[V/m], the thickness of the potential barrier 507 becomes thinner than usual. As a result, electrons in the first electrode are emitted by tunnel effect from the first electrode 201. Generally, response of the tunnel effect is very fast in comparison with that of conventional transistors or diodes. Transient response and frequency characteristics are dependent on a charge-discharge time of a junction capacity of electrodes.

Figure 10:
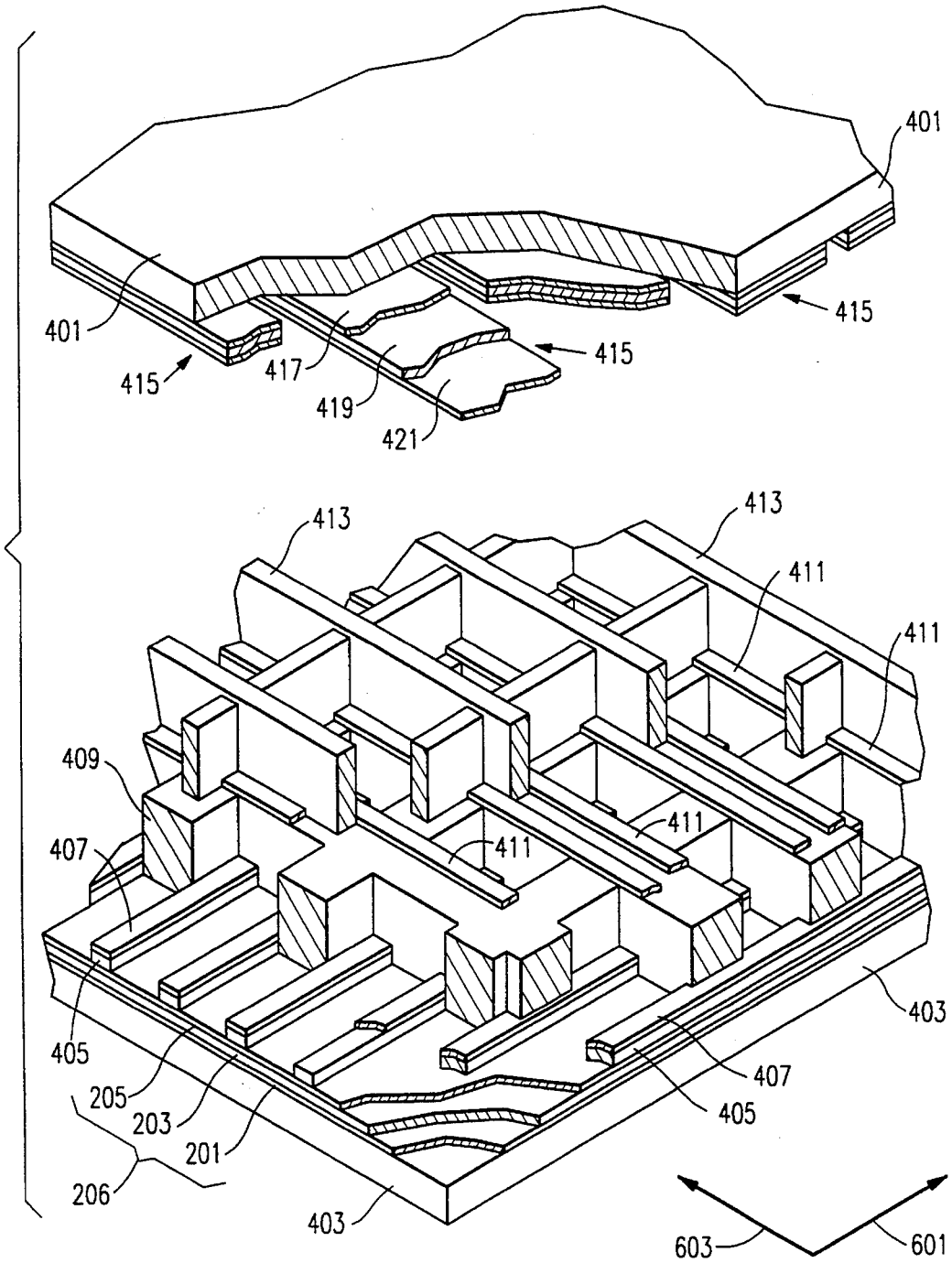
FIG. 10 is a perspective view, partly broken away, of a fourth embodiment of a flat display in accordance with the present invention.

FIG. 10 shows a flat display having an electron emitting device of the type shown in FIG. 7 or FIG. 8. The flat display of the FIG. 10 embodiment has a closed flat vessel having a front panel 401 and a back panel 403. The vessel, including the space between the front panel 401 and the back panel 403, is evacuated or charged with inert gas.

A plurality of dielectric layers 405 are formed on the electron emitting device 206, for example, by the thin film technique. Each dielectric layer 405 is separated by a predetermined distance, and the dielectric layers are parallel with each other. On each dielectric line, row electrodes 407 are formed by the thin film technique in the row direction 601 of the display screen.

Further, a base spacer 409 is formed on the electron emitting device 206 by thick film technique. The base spacer 409 is an insulator and is made of, for example, PbO. The base spacer 409 is formed as a lattice. Therefore, the base spacer 409 defines numerous square windows. Frames of the base spacer 409 in the row direction are positioned between each dielectric layer 405 and row electrode 407. As a result, each of the row electrodes 407 is insulated by the base spacer 409. Further, because of the square windows of the base spacer 409, the electron emitting device 206 is divided into square segments which correspond to display elements of the display screen.

In the column direction 603 of the display screen, a plurality of column electrodes 411 are formed by the thin film technique on the base spacer 409. The column electrodes 411 are extend perpendicularly to the row electrodes 407 and are parallel to each other.

Further, on the base spacer 409, a front spacer 413 is formed by the thick film technique. The front spacer 413 is made of insulator paste such as, for example, PbO. The front spacer 413 has numerous square windows which are defined by frames of the front spacer 413. The windows correspond to the square windows of the base spacer 409. The front spacer 413 insulates adjacent pairs of the column electrodes 411 on each base spacer 409 from each other.

The square window of the front spacer 413 is wider than the square window of the base spacer 409. In other words, the thickness of the base spacer frame is larger than that of the front spacer frame. As a result, electrons from the electron emitting device 206 reach an area of associated phosphors wider than an area defined by frames having a uniform thickness.

Each square segment, which is defined by the base spacer 409 and the front spacer 411, has two row electrodes 407 and two column electrodes 411. Further, the row electrodes 407 and the column electrodes 411 are insulated and separated by a predetermined distance by the base spacer 409 and the front spacer 413.

Anode devices 415 are formed on the front panel 401. The anode devices 415 are formed in a column direction 603 of the display screen which is in the direction of vertical scanning. The anode device 415 comprises an optical transparent electrode 417 made by ITO, a strip of phosphor 419 which emits light when exited by electrons, and an aluminum thin film 421. Alternatively, a set comprised of one transparent electrode and one aluminum thin film may be used in a similar manner to that used in the embodiment shown in FIG. 1.

In one anode device, the strip of phosphor 419 corresponds to one of three kinds of phosphor 419*a*, 419*b* and 419*c* which respectively represents three components of light. Three kinds of phosphor are cyclically provided for emitting red, green and blue light respectively, upon excitation by electrons. As a result, a color image is displayed.

Figure 11:
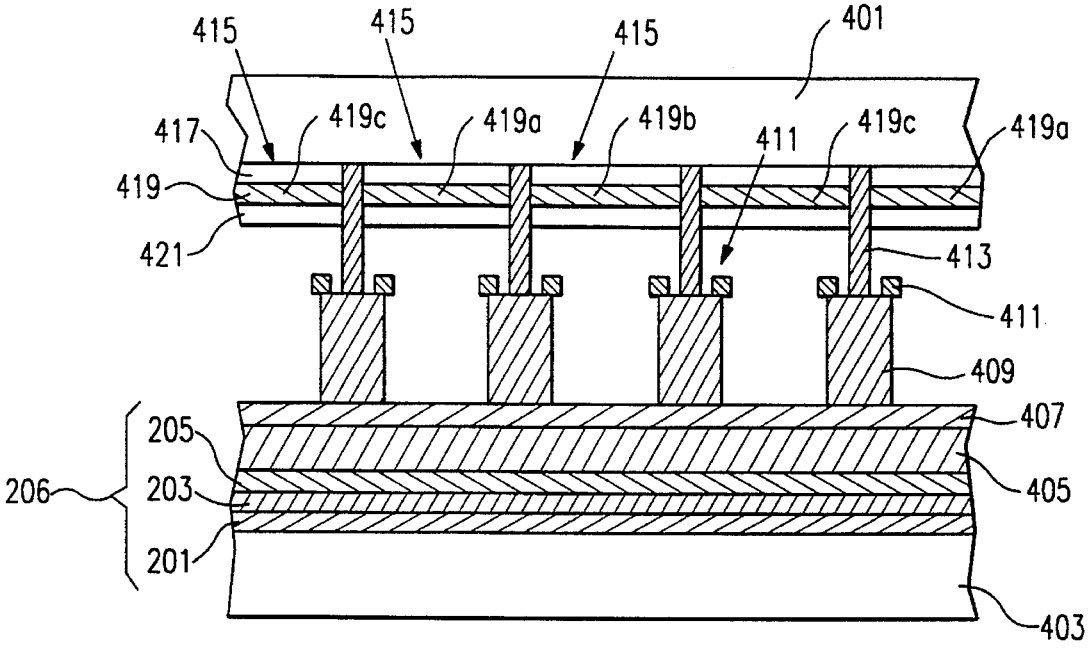
FIG. 11 is a sectional view of the flat display of FIG. 10.

In FIG. 10 and FIG. 11, to simplifying the drawings, pinholes 207 in the electron emitting device 206 are omitted. Electrons are emitted from the electron emitting device 206 on application of an electric field of about $10^9$[V/m] between the first electrode 201 and the second electrode 205. Electrons from the electron emitting device 206 are controlled by the row electrodes 407 and the column electrodes 411. Namely, an intersection of each row electrode 407 and each column electrode 411, both subjected to the application of a predetermined positive control voltage, is selected, and electrons can reach an anode electrode device 415. A predetermined negative control voltage is applied to non-selected row and column electrodes.

Electrons passing through square windows of the base spacer 409 and the front spacer 413 are accelerated by an anode voltage which is applied between the anode electrode device 415 and the electron emitting device 206, and strike associated segments of strips of phosphor. Excited phosphors emit corresponding colored light, and thus, color images are displayed on the display screen.

Figure 12:
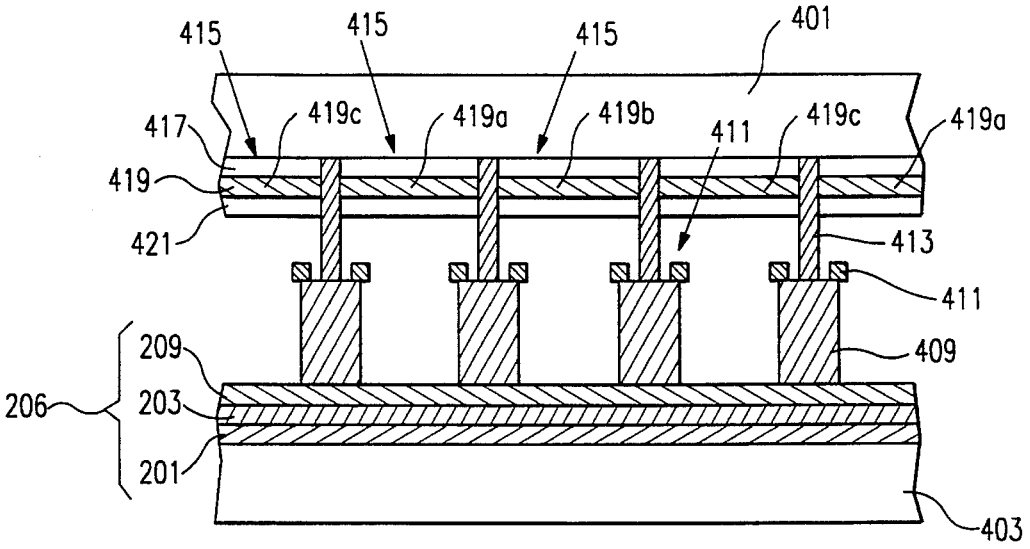
FIG. 12 is a sectional view of a fifth embodiment of a flat display in accordance with the present invention.

Another embodiment as shown in FIG. 12 does not have row electrodes as in the case of FIG. 10 and FIG. 11. In place of row electrodes, a second electrode 209 is divided into a predetermined number of strips. Further, each of the second electrodes 209 is insulated by an insulator (not shown in FIG. 12).

In this embodiment, a row is selected by applying a positive voltage to the second electrode 209 to be selected. As a result, the selected row of the electron emitting device 121 emits electrons. Further, the selected column electrode 411 to which a positive control voltage is applied allows electrons to pass an associated square window of the base spacer 409 and the front spacer 413. Therefore, selected phosphor strips emit light and images are displayed on the display screen.

In the embodiments shown in FIG. 10, FIG. 11 and FIG. 12, the thickness of the base spacer frame is larger than that of the front spacer frame. As a result, the strength of the combined spacer (base spacer 409 and front spacer 413) is maintained and the distance between the front panel and back panel is uniformly maintained over a substantially large area. Further, electrons from the electron emitting device are not obstructed by the base and the second spacer.

What is claimed is:

1. An electron emitting device comprising:

base plate;

first film electrode formed on said base plate;

dielectric film formed on said first film electrode;

second film electrode formed on said dielectric film; and plurality of pinholes extending through said first film electrode, said second film electrode and said dielectric film, adjacent pairs of the pinholes being spaced from each other by a predetermined pitch, wherein electrons are directly emitted from said first film electrode.

2. A flat display comprising:

a closed vessel, said vessel having an optically transparent front panel and a back panel opposite said front panel;

an anode assembly disposed adjacent to said front panel, said anode assembly having an anode electrode comprising a phosphor layer for emitting light upon excitation by electrons;

spacer means for providing a desired distance between said front panel and said back panel; and electron emitting means for emitting electrons by field emission, said electron emitting means being disposed adjacent to said back panel and said electron emitting means having a first film electrode formed on said back panel, a dielectric film formed on said first film electrode, a second film electrode formed on said dielectric film, and a plurality of pinholes extending through said first film electrode said second film electrode and said dielectric film, adjacent pairs of said pinholes being spaced from each other by a predetermined pitch, wherein said electrons are emitted directly from said first film electrode and pass through a plurality of windows formed in said spacer means so that said electrons are received by said anode assembly.

3. A flat display comprising:

a closed vessel, said closed vessel having an optically transparent front panel and a back panel opposite said front panel;

an anode assembly disposed adjacent to said front panel, said anode assembly having an anode electrode and a phosphor layer for emitting light upon excitation by electrons;

spacer means for providing a desired distance between said front panel and said back panel;

electron emitting means for emitting electrons by field emission, said electron emitting means being disposed adjacent to said back panel and said electron emitting means having a first film electrode formed on said back panel, a dielectric film formed on said first film electrode, a second film electrode formed on said dielectric film, and a plurality of pinholes extending through said first film electrode, said second film electrode and said dielectric film, adjacent pairs of said pinholes being spaced from each other by a predetermined pitch, wherein said electrons are emitted directly from said first film electrode and pass through a plurality of windows formed in said spacer means so that said electrons are received by said anode assembly; and selecting means coupled to each of said plurality of windows formed in said spacer means for controlling passage therethrough of electrons from said electron emitting means.

4. A flat display comprising:

a closed vessel, said closed vessel having an optically transparent front panel and a back panel opposite said front panel;

an anode assembly disposed adjacent to said front panel, said anode assembly having an anode electrode and a phosphor layer for emitting light upon excitation by electrons;

spacer means for providing a desired distance between said front panel and said back panel;

electron emitting means for emitting electrons by field emission, said electron emitting means being disposed adjacent to said back panel and said electron emitting means having a first film electrode formed on said back panel, a dielectric film formed on said first film electrode, a second film electrode formed on said dielectric film, and a plurality of pinholes extending through at least said second film electrode and said dielectric film, adjacent pairs of said pinholes being spaced from each other by a predetermined pitch, wherein said electrons are emitted directly from said first film electrode and pass through a plurality of windows formed in said spacer means so that said electrons are received by said anode assembly; and selecting means coupled to each of said plurality of windows formed in said spacer means for controlling passage therethrough of electrons from said electron emitting means, wherein said anode assembly comprises a transparent electrode formed on said front panel, an anode electrode and a phosphor layer disposed between said transparent electrode and said anode electrode.

* * * * *